US005218820A

United States Patent [19]

Sepehri et al.

[11] Patent Number: 5,218,820

[45] Date of Patent: Jun. 15, 1993

[54] HYDRAULIC CONTROL SYSTEM WITH PRESSURE RESPONSIVE RATE CONTROL

[75] Inventors: Nariman Sepehri; Réal N. Frenette; Peter D. Lawrence, all of Vancouver, Canada

[73] Assignee: The University of British Columbia, Vancouver, Canada

[21] Appl. No.: 720,364

[22] Filed: Jun. 25, 1991

[51] Int. Cl.[5] ..... F16D 31/02; F15B 11/08

[52] U.S. Cl. ..... 60/463; 91/419; 91/433; 91/435; 91/462

[58] Field of Search ..... 91/275, 361, 433, 459, 91/419, 435, 462; 60/459, 462, 463

[56] References Cited

U.S. PATENT DOCUMENTS

| | | | |
|---|---|---|---|
| 3,126,031 | 3/1964 | Hayner | 91/419 X |
| 3,727,520 | 4/1973 | McKown et al. | 91/433 |
| 3,958,492 | 5/1976 | Curless | 91/462 X |
| 4,081,021 | 3/1978 | Bills | 164/154 |
| 4,145,959 | 3/1979 | Burden et al. | 92/8 |
| 4,275,793 | 6/1981 | Schivley, Jr. et al. | 91/433 X |
| 4,700,610 | 10/1987 | Bauer et al. | 91/433 X |
| 4,712,470 | 12/1987 | Schmitz | 91/433 |
| 4,765,225 | 8/1988 | Birchard | 91/435 X |
| 4,970,941 | 11/1990 | Reinhardt | 91/433 |
| 5,079,989 | 1/1992 | Chipp et al. | 91/361 |
| 5,138,838 | 11/1992 | Crosser | 60/433 |

OTHER PUBLICATIONS

Earthmoving, Report Construction Equipment pp. 71 and 72, Jun. 1991.

*Primary Examiner*—Edward K. Look
*Assistant Examiner*—John Ryznic
*Attorney, Agent, or Firm*—C. A. Rowley

[57] ABSTRACT

A hydraulic control system for controlling the motion of a double acting hydraulic actuator determines the flow to and from the actuator in accordance with 1. the desired movement of the actuator
2. the measured hydraulic pressures on opposite sides of the piston of the actuator
3. a selected, predefined model of the system of which the actuator forms a part and sets the valves controlling the flows accordingly.

4 Claims, 4 Drawing Sheets

HYDRAULIC CONTROL SYSTEM WITH PRESSURE RESPONSIVE RATE CONTROL

FIELD OF THE INVENTION

The present invention relates to a hydraulic actuator control. More particularly the present invention relates to a hydraulic actuator control System, the operation of which is modified in accordance with the pressures on the double acting hydraulic actuator which reflect the actual load conditions imparted to the actuator from the element being manipulated by the actuator.

BACKGROUND OF THE PRESENT INVENTION

It is known to control hydraulic equipment such as excavators and the like using a resolved motion control systems wherein operator inputs controlling end point movement are applied to a computer system which computes, for example, by inverse kinematics or the like, the angular adjustments or movements of the joints and the speed of such adjustments or movements required to attain the desired end point movement and provides signals to control adjustment of the control valve for each actuator causing the actuator to adjust relationships of the elements controlled to obtain the desired end point movement.

Generally the control valve for each actuator is a spool valve that adjusts flow, for example, to a selected end of the double acting hydraulic actuator and permits flow of fluid from the unselected end of the actuator (to the tank).

It will be apparent that manipulating the control valve to obtain a desired movement of the actuator must also ensure that, in fact, the required movements of the various elements of the system (e.g. arm segments of an articulated arm) to move the end point to the desired location are taking place and at the required or desired rate. If the required movement is lagging behind the desired movement as commanded by the operator by too great a distance problems may be encountered and it has been found desirable to modify the instructions to the control valves when a discrepancy between the desired and actual end point position exceeds certain limits (see U.S. patent application Ser. No. 07/556,417 filed Jul. 24, 1990 Frenette et al).

It will further be apparent that the actual conditions or forces necessary to manipulate the arm and move the end point to the desired location may vary widely depending on, for example, the load being moved, i.e. the resistance (or lack thereof) to movement.

BRIEF DESCRIPTION OF THE PRESENT INVENTION

The object of the present invention is to provide a hydraulic control system that compensates for the actual load or resistance to movement being encountered when the element is being manipulated.

Broadly the present invention relates to a hydraulic control system for applying hydraulic fluid to a double acting hydraulic actuator having a moveable element, comprising a computer means, means for inputting signals defining the desired rate and direction of movement of said moveable element to said computer means, means for sensing hydraulic pressure acting on a first side of said double acting hydraulic actuator to provide a first pressure signal to said computer means indicating the hydraulic pressure on said first side, means for sensing the hydraulic pressure acting on a second side of said double acting hydraulic actuator opposite said first side of said double acting hydraulic actuator and for providing a second pressure signal to said computer means indicating the hydraulic pressure acting on said second side, valve means for adjusting the rate of flow of hydraulic fluid to or from each of said first and said second sides of said double acting actuator, said computer means adjusting said valve means to set said flows of hydraulic fluid to or from said first and said second sides of said double acting hydraulic actuator to control movement of said double acting actuator based on said rate and direction of movement signals modified in accordance with said pressure signals from said input and said output sides of said actuator to obtain the desired movement of said moveable element while compensating for the loading on said moveable element.

Preferably said actuator will control movement of one joint of a manipulator arm.

BRIEF DESCRIPTION OF THE DRAWINGS

Further features, objects and advantages will be evident from the following detailed description of the preferred embodiments in the present invention taken in conjunction with the accompanying drawings in which.

DESCRIPTION OF THE PREFERRED EMBODIMENTS

Figure 1:
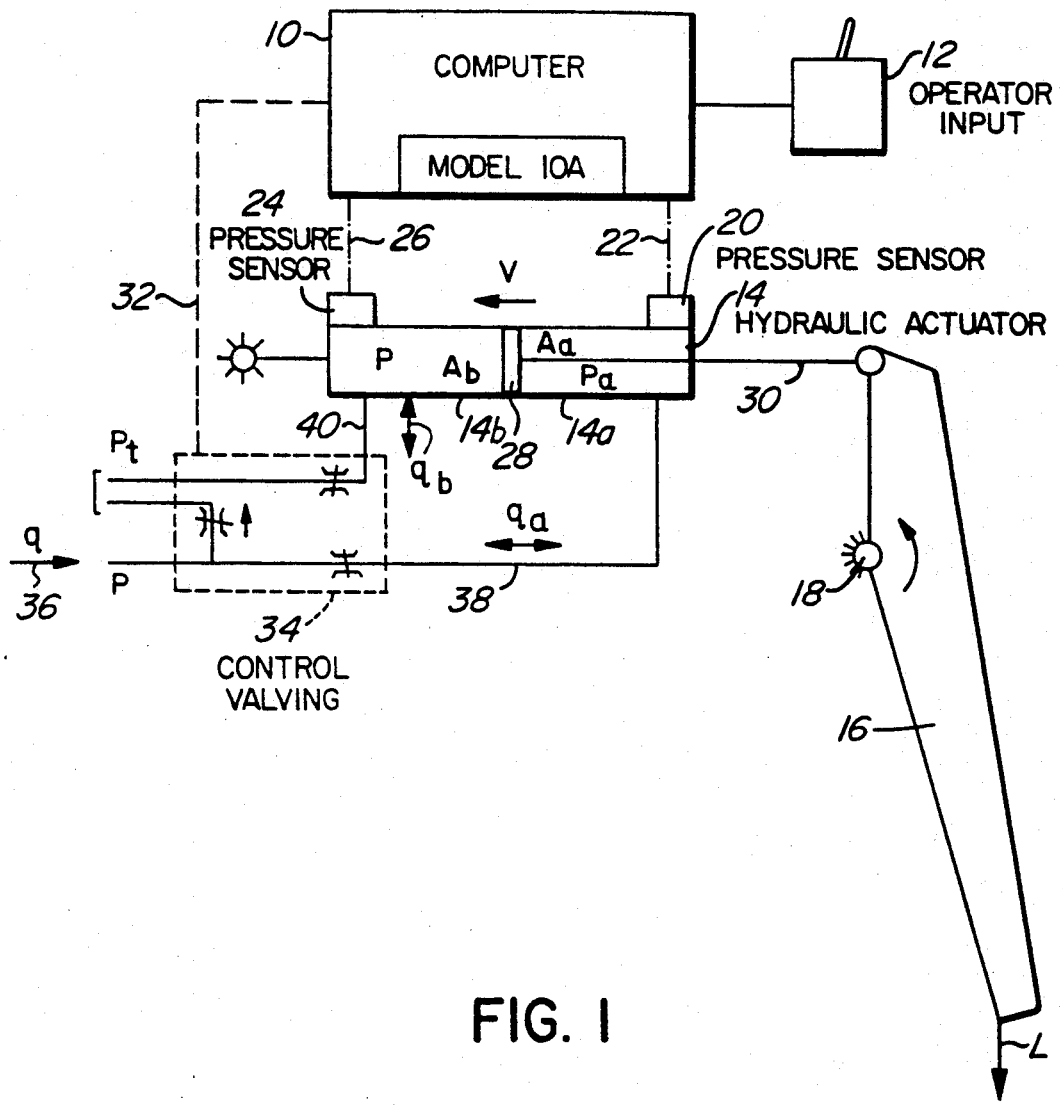
FIG. 1 is a schematic illustration of a control system constructed in accordance with the present invention shown in one particular mode of operation.

As shown in FIG. 1 the system of the present invention comprises a computer 10 which receives an operator's signal input from either a keyboard or as illustrated from a suitable joystick or the like 12. The operator input 12 determines the desired position or change in position of an end point such as a position of a bucket of an excavator or the like and the rate at which such change is to be implemented which defines to the computer the desired rate and direction of movement the end point is intended to move. In a simple one link arm the desired movement of an end point is directly related to the operator joystick input, but in more complicated arms the movement of the actuators (moveable elements thereof) must individually be determined for each arm segment where a number of actuators must be manipulated to move a number of arm segments to obtain a desired end point movement of the end of the arm.

In a simple system as shown in FIG. 1, the computer 10 determines through inverse kinematics or the like, the necessary movement of the double acting hydraulic actuator 14 to move the single link or arm segment, say stick 16, about its pivot point 18. The actual load on the stick 16, as indicated by the arrow L, may vary significantly (in both magnitude and direction), for example for an excavator by the weight in the bucket or the force applied by the bucket in digging or the like.

A suitable pressure sensor 20 senses a first hydraulic pressure $p_a$ on a first side $\mathbf{14}_a$ of the double acting hydraulic actuator 14 and transmits its signal via line 22 to the computer 10.

Similar pressure sensor 24 senses a second pressure $p_b$ at a second side $14_b$ of the double acting actuator 14 remote from the first side $14_a$ and feeds this information to the computer 10 via line 26.

The computer 10 is programmed with models 10A of the hydraulic actuator(s) 14 under different load conditions as will be described hereinbelow.

In the arrangement illustrated the area $A_b$ on the second side $14_b$ of the actuator 14 i.e. of the piston or moveable element 28 of the hydraulic actuator 14 is larger than (as a result of the shaft 30 extending from the piston 28) the area of first side of piston 28 indicated at $A_a$.

The computer 10 includes the information on the areas $A_a$, $A_b$ and receives the pressure signals for the pressures $p_a$ and $p_b$ which are functions of the load L on the arm 16 as well.

In the illustration the computer 10 provides a control signal as indicated by the line 32 which regulates the control valve 34 to obtain the desired flow rate (it will be apparent that the computer 10 must also know and contain within its model, the characteristics of the pump diagrammatically represented by the arrow 36 which delivers hydraulic fluid to the control valve 34 at a flow rate q, and pressure p).

In the illustrated arrangement, the command is to move the arm 16 around the pivot 18 and lift the load L which requires movement of the piston 28 to the left at a desired velocity V designated by the arrow as a function of the operator input command.

It will be apparent that movement to lift requires flow $q_a$ through the valve system via line 38 to the first side $14_a$ of the piston 28 and a different flow $q_b$ through the line 40. These flows are indicated by the arrows $q_a$ and $q_b$ respectively and must be different for any movement of the piston 28 due to the different areas $A_a$ and $A_b$ respectively on opposite sides of the piston 28.

The pressure, $p_a$ is high (it is supporting the load L) and obviously the pressure p in the fluid passing through the line 36 must be significantly higher than the pressure $p_a$ on the first side $14_a$ of the actuator 14 to obtain flow to the actuator side $14_a$, and the quantity of this flow $q_a$ in the line 38 must be coordinated to produce the desired movement of the piston 28 at the desired rate as represented by the arrow V. The quantity $q_a$ is primarily dependent on the pump pressure p delivered to the valve 34 (i.e. $p-p_a$) and the opening through Such movement can only occur in the direction of the arrow V if the flow of fluid $q_b$ from the output side $14_b$ is also occurring at the required rate.

The computer 10 must adjust the setting of the control valve 34 to ensure that the required conditions exist, i.e. that the flow $q_a$ through line 38 is that required to obtain the desired movement of the piston 28. Under these conditions adjusting the valving 34 to control the flow through line 38 is required and this information will be obtained from the model 10A of the system forming part of the computer 10. The fluid is driven from side $14_b$ as the piston 28 is moved in the direction of the arrow V and thus the setting of the valve 34 must permit this flow.

In the event that the objective was to move the arm 16 in the opposite direction at the same speed, flows $q_b$ and $q_a$ would be of the same magnitude but in opposite directions. In this case it may again be necessary to adjust the control valving 34 to control the rate of flow through the line 38, i.e. flow directed back to the tank from the side $14_a$ and the pressure and flow $q_b$ applied via the line 40 would pass to the side $14_b$ of the actuator 14, i.e. the pump would be disconnected from the line 38 and connected to the line 40. However, due to the effect of the load L there may be no necessity to apply any significant pump pressure and the operation would be controlled by throttling the flow $q_a$. In this case the control valve 34 would be adjusted to control the flow from the first side $14_a$ through line 38 to the tank and the flow from the pump p through the line 40 to the side $14_b$ made to match the flow in line 38. This information would be given by the models 10A which will be described in more detail hereinbelow in reference to models 1 and 2.

It will be further noted that the line pressures p and $p_a$ or $p_b$ may vary depending on the load L, thus the rate of the flows in the lines 38 or 40 may change substantially for a given orifice size valve opening. The computer 10 is able to calculate the desired flow for the desired movement and based on the pressure conditions on the double acting actuator 14 to determine which of the flows, i.e. $q_a$ or $q_b$ requires regulating and to set the control (spool) valve accordingly based on the models 10A.

Figure 2:
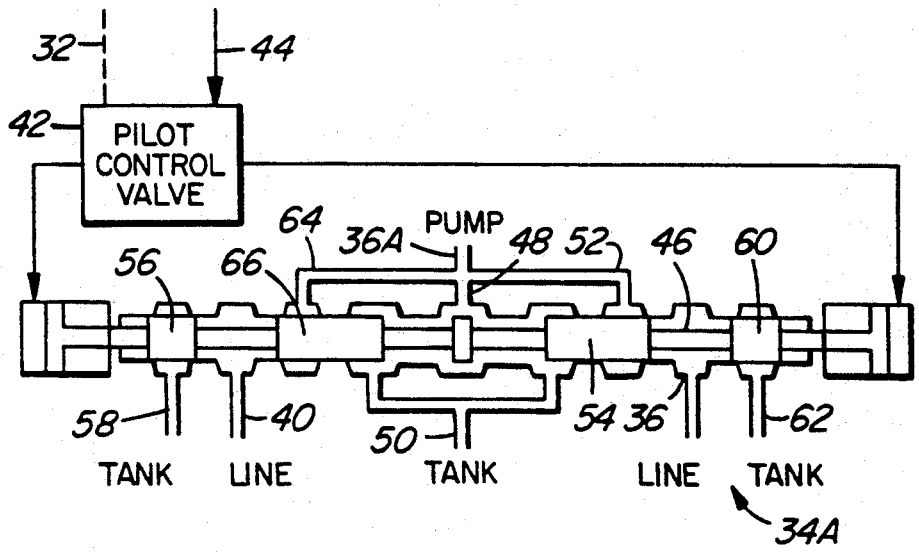
FIG. 2 is a schematic illustration of a conventional spool valve used to control the double acting actuator.

A typical spool type control valve 34A is illustrated in FIG. 2. As shown, the valve has a main input from the pump indicated at 36A. As shown a pilot control valve 42 is controlled via a signal coming via line 32 from the computer 10 to adjust its position and direct hydraulic fluid under pressure entering as indicated by the arrow 44 to opposite sides of the spool valve 34A to shift the spool 46 of the spool valve 34A to the left or to the right to the desired degree as determined by the signal from line 32.

In the position illustrated, the fluid flow from the pump as indicated at 36A passes via the central line 48 and flows back to the tank by a line 50.

If it is desired to move the piston 28 to the left and the pressure must be applied from the pump 36A to the line 38. The spool 46 must be shifted to the left so that the branch line 52 from the pump 36A communicates directly with the line 38, i.e. the land 54 moves to the left and directly connects line 38 to the supply from the pump 36A and disconnects the pump 36A from the line 50. At the same time the land 56 at the left end of the spool 46 is also moved to the left. This connects line 40 from the actuator at pressure $p_b$ to the tank via line 58.

In the above conditions it will be apparent that the opening or shifting of the land 54 is the controlling element in determining the speed of movement of the piston 28 (rate of flow of fluid to the actuator) and thus the computer 10 sends a signal to the pilot valve 42 resulting in the desired movement of the spool 46 to adjust the position of the land 54 to obtain the required flow from line 52 through line 38 to the double acting actuator 14.

If movement in the opposite direction is desired then the spool 46 must be moved in the opposite direction (to the right) and the land 60 moves to the right opening the passage between the line 38 and the line 62 leading to the tank, while at the same time the land 54 prevents the connection between lines 38 and 52, and the land 56 disconnects the line 58 from the line 40, and the line 40 is connected to line 64 from the pump 36A by the position of the land 66.

As above indicated because of the differential in the forces (acting on the piston) due to the pressures $p_a$ and $p_b$ in conjunction with the models 10A dictates which spool land governs the motion of the piston to the right, i.e. the flow from the line 38 back to the tank or the flow from the pump 36A through line 40. Assuming flow through line 38 to the tank i.e. from side $\mathbf{14}_a$ is to be controlled the pilot control valve 42 adjusts the position of the spool 46 to open the passage between line 38 and 62 to obtain the required flow rate. If the acting force on the piston 28 is reversed, it may well be that the flow to the actuator via line 40 would be the governing flow and the computer 10 would signal the pilot valve 42 to position the spool 46 to obtain the desired flow from line 64 to line 40.

Figure 3:
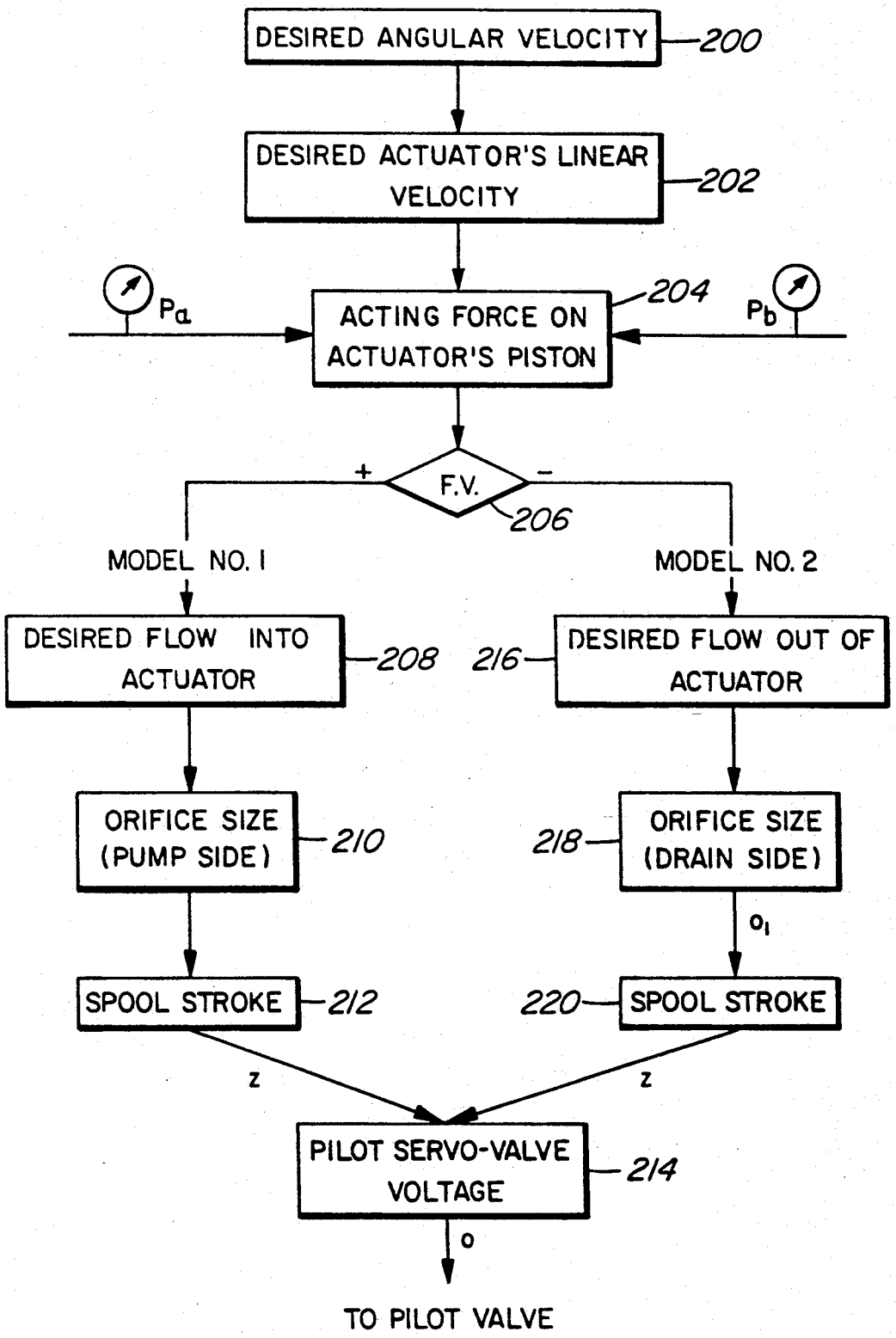
FIG. 3 is a flow chart of one embodiment of the present invention.

FIG. 3 shows a typical flow chart for a control system for a double acting actuator.

As illustrated, based on the input from the operator, the computer determines the desired movement, i.e. angular velocity of a pivoted joint (angular velocity magnitude and direction), and applies this angular velocity signal as indicated at 200 to determine the desired actuator 14 linear velocity, i.e. the velocity V as indicated at 202. This information is supplemented by the pressures $p_a$ and $p_b$ which define the forces (based on $A_a$ and $A_b$) acting on opposite sides of the actuator piston 28 as indicated at 204. The sign of the net force on the piston then used at 206 to select whether the control is to be based on flow into the actuator from the pump 36, 36A as determined by Model 1 or flow out of the actuator to the tank based on Model 2.

In the event that Model 1 is selected e.g. movement of the piston 28 to the left as illustrated in FIG. 1, the desired flow $q_a$ to the actuator 14 is determined at 208 and based on the pressures acting on the piston 28 the orifice size (opening of the valve) is determined as indicated at 210. The spool stroke as indicated at 212 is then determined based on the minimum displacement of the spool to obtain the desired flow as indicated at 212 and a corresponding voltage for the pilot valve 42 is generated as indicated at 214.

In the cases where flow from the pump to the actuator 14 controls the motion of the actuator as above described equations 1 and 2 (hereinbelow) forming Model 1 apply $$Q-Q_i=ka_t\sqrt{(P-P_t)} \quad (1)$$

$$Q_i=ka_i\sqrt{(P-P_i)} \quad (2)$$

where $Q$=pump flow [$cm^3$/sec]

$Q_i$=desired flow to the actuator 14 [$cm^3$/sec]

$P$=pump pressure and is an unknown [$N/cm^2$]

$P_t$=tank pressure (usually constant, but may be measured) [$N/cm^2$]

$P_i$=pressure on the incoming side of the actuator ($p_a$ or $p_b$) [$N/cm^2$]

$a_i$=pump to cylinder orifice area and is an unknown [$cm^2$]

$a_t$=orifice area from pump to tank or to next actuator valve and is an unknown [$cm^2$]

$k=c_d\sqrt{2/\rho}$ (metering coefficient) [$\sqrt{cm^3/Kg}$]where $c_d$=coefficient of discharge of the orifice or restrictor and $\rho$=density of the hydraulic fluid [$\sqrt{Kg/cm^3}$]

The equations 1 and 2 should be solved simultaneously to define the correct spool displacement and since they are nonlinear an iterative method is preferred to solve them.

On the other hand if the instructions from the computer are to control flow from the actuator to the tank, e.g. to move the piston 28 to the right Model 2 is followed and the desired flow out of the actuator, i.e. $q_a$ this time toward the valving 34 is determined as indicated at 216 and this flow and the differential in pressure between the tank or reservoir $p_t$ (see FIG. 1) and the pressure $p_a$ defines the orifice size as indicated at 218 to obtain the desired flow rate back to the tank (assuming that the load L is sufficient to obtain the desired movement of the piston 28 at the desired speed). On the other hand if the load L was too small to obtain this movement flow from the pump p to the second side $\mathbf{14}_b$ of the actuator 14 must be controlled.

Model 2 governs when flow from the actuator to the tank is to be controlled and is based on equation 3 as follows $$a_o=\frac{Q_o}{[k\sqrt{(P_o-P_t)}]} \quad (3)$$

where $a_o$=cylinder to tank orifice area [$cm^2$]

$Q_o$=desired flow from cylinder to the tank [$cm^3$/sec.]

$P_o$=line pressure on the outflowing side of the actuator [$N/cm^2$]and $P_t$ and k are as above defined.

In any event, once the orifice size is determined the spool stroke 220 can be determined and the pilot valve voltage set as indicated at 214.

Figure 4:
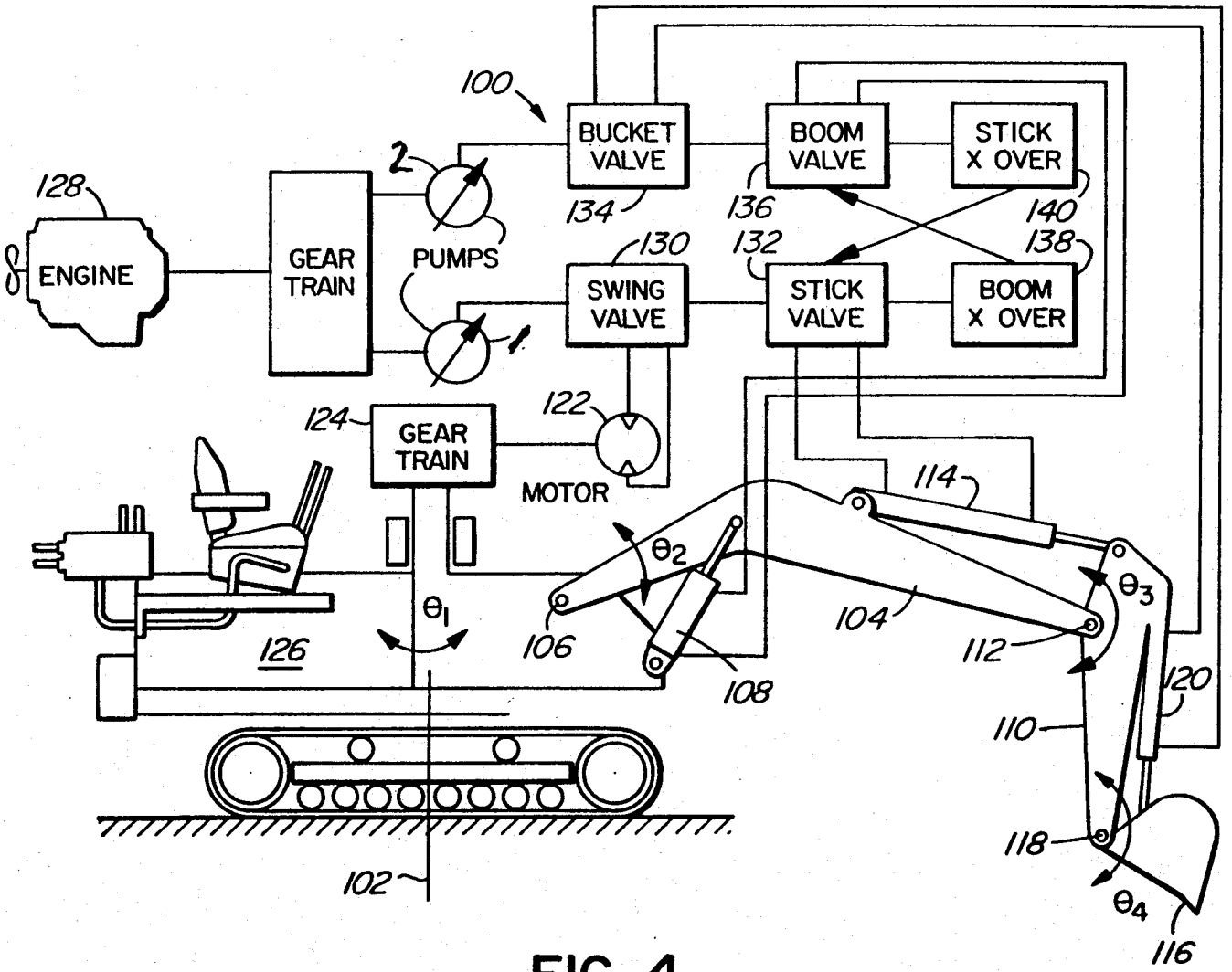
FIG. 4 is a typical hydraulic system for operating an excavator.

It will be apparent that in any piece of equipment, generally more than a single actuator will be present and in many cases these actuators will have to be operated simultaneously to obtain the desired movement of the end point. A typical system 100 is illustrated in FIG. 4 which shows an excavator having a body or cab 126 which is rotated about the vertical axis as indicated at 102 via a hydraulic motor 122 and gearing 124 as indicated by swing $\Theta_1$; a boom 104 which is pivoted about the axis 106 as indicated by the angle $\Theta_2$ via a double acting actuator 108; a stick 110 moveable around an axis 112 as indicated by the angle $\Theta_3$ via a double acting actuator 114; and a bucket 116 moveable about the axis 118 as indicated by the angle $\Theta_4$ via double acting actuator 120.

In this system it will be apparent that actuation of the double acting cylinders 108, 114, 120 and the swing motor 122 driving the gear train 124 and thus the swing of the cab 126, are all coupled and require power to operate. This power is derived from the engine 128 which, through a suitable gear train or the like, drives the hydraulic pump, in the illustrated arrangement two separate pumps are used as indicated at 1 and 2.

In this illustration pump 1 serves the swing valve 130 and stick valve 132 to manipulate the motor 122 and the double acting hydraulic actuator 114 respectively. Pump 2 on the other hand supplies the fluid for the bucket valve 134 which controls flow to the double acting cylinder 120 and the boom valve 136 which controls flow to the double acting cylinder 108. Pumps 1 and 2 change their output flows depending on the load in a well known manner to prevent the engine from stalling.

In some cases the output from pump 1 may be shifted to facilitate movement of the boom 104 as indicated by the boom cross-over 138, and similarly the pump 2 may be used to apply fluid to stick valve 132 as indicated by the stick cross-over 140 depending on the demands of the system.

Figure 5:
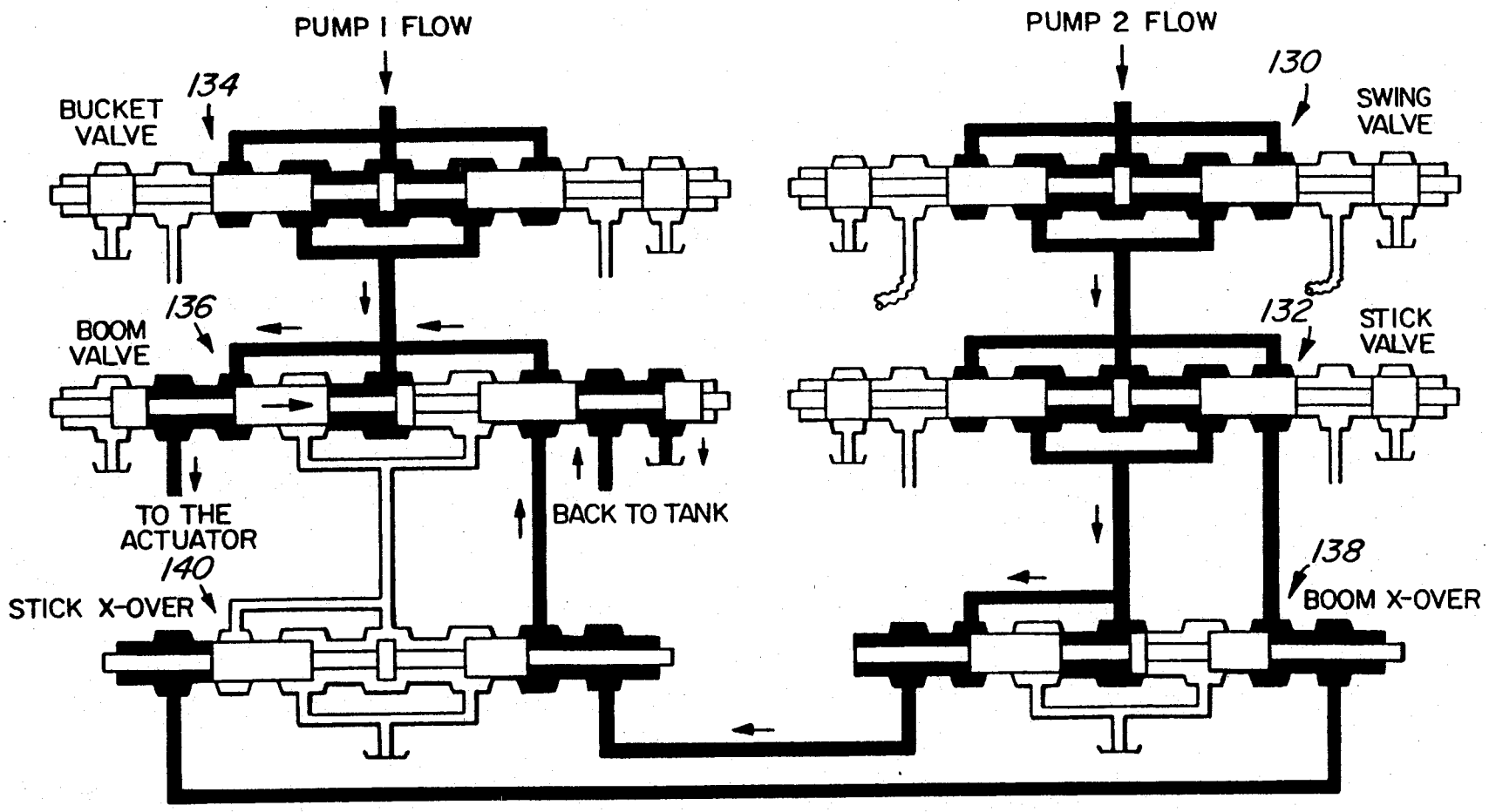
FIG. 5 is a schematic illustration of a typical valve system showing the manner in which the various spool valves are connected.

FIG. 5 schematically illustrates the typical hydraulic interconnections of the system described above with respect to FIG. 4 during boom-up motion.

A model of the actuators 108, 114, 120 and 122 takes into account variations in pump output flows that will be obtained depending on the actual demands of the pump which obviously requires information about the operating condition of the various elements in the overall hydraulic circuit.

The relative angular velocities of the arm segments of the arm provide a certain end point trajectory. Each joint velocity is related to the flow directed to its corresponding actuator. The model ensures that the required flow could be provided by the hydraulic circuit. The model, thus, performs the necessary changes in the desired relative angular velocities to satisfy this condition. This is done by systematically scaling down the desired velocities to have close to optimum speed for the manipulator when following a path. A preferred system is described in a companion application by Sepehri et al filed concurrently herewith and titled Proportional Hydraulic Control.

Having described the invention, modifications will be evident to those skilled in the art without departing from the spirit of the invention as defined in the appended claims.

We claim:

1. A hydraulic control system for applying hydraulic fluid flow to a double acting hydraulic actuator having a moveable element comprising a computer means, means for inputting signals to said computer means, said signals defining the desired rate and direction of movement of said moveable element, means for sensing a first hydraulic pressure on a first side of said double acting hydraulic actuator and sending a first signal to said computer means, means for sensing a second hydraulic pressure on a second side of said double acting hydraulic actuator and sending a second signal to said computer means, said second side being opposite said first side, reservoir means, pump means, valve means for controlling flow of said hydraulic fluid to or from each of said first and second sides of said hydraulic actuator and for selectively connecting said flow of said hydraulic fluid between said first or second sides and said pump means or between said first or second sides and said reservoir means, said computer means determining net force applied by said first and second pressures to said actuator based on said first and second pressures and the respective area of said actuator against which said first and second pressures are applied, said computer determining which of said flows between said first or said second sides and said pump means or said reservoir means must be controlled based on said net force applied by said first and second pressures to said double acting hydraulic actuator and said desired direction of movement of said moveable element thereby to select an orifice of said valve means to be controlled, said computer means adjusting said valve means to set said selected orifice to a required orifice area to obtain the required flow rate to obtain said desired rate and direction of movement when said flow is from said pump means to said actuator in accordance with a calculated pump pressure and when said flow is from said actuator in accordance with the one of said first and second pressures from the side of the actuator from which fluid is to flow to obtain the desired movement of said moveable element while compensating for the load on said actuator.

2. A hydraulic control system as defined in claim i wherein said actuator controls movement of one joint of an actuator arm.

3. A hydraulic control system as defined in claim 1 wherein said when said flow is from said pump means to said actuator said orifice area of said selected orifice is calculated by solving simultaneously the following equations 1 and 2;

$$Q-Q_i=ka_i\sqrt{(P-P)} \quad (1)$$

$$Q_i=ka_i\sqrt{(P-P_i)} \quad (2)$$

where $Q$=pump means flow [cm$^3$/sec]

$Q_i$=desired flow to the actuator 14 [cm$^3$/sec]

$P$=pump means pressure and is an unknown [N/cm$^2$]

$P_l$=reservoir means pressure (usually constant, but may be measured) [N/cm$^2$]

$P_i$=pressure on the incoming side of the actuator ($p_a$ or $p_b$) [N/cm$^2$]

$a_i$=orifice area; said pump means to said actuator and is an unknown [cm$^2$]

$a_l$=orifice area; said pump means to said reservoir means or to a next actuator valve and may be an unknown [cm$^2$]

$k=c_d\sqrt{2/\rho}$(metering coefficient) [$\sqrt{\text{cm}^3/\text{Kg}}$] where $c_d$=coefficient of discharge of said selected orifice and $\rho$=density of said hydraulic fluid [$\sqrt{\text{Kg/cm}^3}$].

4. A hydraulic control system as defined in claim 3 wherein when said flow is from said actuator said orifice area of said selected orifice is calculated based on the following equation 3;

$$a_o = \frac{Q_o}{[k\sqrt{(P_o - P_l)}]} \quad (3)$$

where $a_o$=orifice area; actuator to reservoir means [cm$^2$]

$Q_o$=desired flow from actuator to reservoir means [cm$^3$/sec.]

$P_o$=said one pressure on the outflowing side of said actuator [N/cm$^2$].

* * * * *